US007186131B2

(12) United States Patent
Kurtz et al.

(10) Patent No.: US 7,186,131 B2
(45) Date of Patent: Mar. 6, 2007

(54) VIBRATION ISOLATED TRANSDUCER CONNECTOR

(75) Inventors: Anthony D. Kurtz, Ridgewood, NJ (US); Adam Kane, Morristown, NJ (US); Richard Martin, Ridgewood, NJ (US)

(73) Assignee: Kulite Semiconductor Products, Inc., Leonia, NJ (US)

( * ) Notice: Subject to any disclaimer, the term of this patent is extended or adjusted under 35 U.S.C. 154(b) by 0 days.

(21) Appl. No.: 10/393,099

(22) Filed: Mar. 19, 2003

(65) Prior Publication Data

US 2004/0185702 A1 Sep. 23, 2004

(51) Int. Cl.
*H01R 13/648* (2006.01)

(52) U.S. Cl. ..... 439/382; 310/326; 310/338; 310/344

(58) Field of Classification Search ..... 439/76.1, 439/95, 382, 384, 913, 559; 73/116, 117.3; 310/326, 338, 344
See application file for complete search history.

(56) References Cited

U.S. PATENT DOCUMENTS 1,964,541 A * 6/1934 Soreny ..... 439/569
4,362,139 A * 12/1982 Isobe et al. ..... 123/364
4,369,659 A * 1/1983 Wareham ..... 73/708
4,501,462 A * 2/1985 Fidi ..... 439/382
4,888,662 A * 12/1989 Bishop ..... 361/283.1
5,095,764 A * 3/1992 Saner ..... 73/862.59
5,131,867 A * 7/1992 Peloza et al. ..... 439/557
5,234,221 A * 8/1993 Freisleben ..... 277/312
5,876,235 A * 3/1999 Yoshigi ..... 439/384
5,911,592 A * 6/1999 Lew et al. ..... 439/383
5,947,766 A * 9/1999 Tsuji et al. ..... 439/559
5,955,771 A 9/1999 Kurtz et al. ..... 257/419
5,993,223 A * 11/1999 Rehhoff ..... 439/76.1
6,291,988 B1 * 9/2001 Hagen et al. ..... 324/207.13
6,590,777 B2 * 7/2003 Morino et al. ..... 361/736
2003/0185412 A1 * 10/2003 Gebert et al.

* cited by examiner

*Primary Examiner*—Briggitte Hammond
*Assistant Examiner*—Larisa Tsukerman
(74) *Attorney, Agent, or Firm*—Plevy, Howard & Darcy PC

(57) ABSTRACT

A transducer including a transducer body, a sensor associated with the transducer body, an electrical connector assembly fastened to an end of the transducer body, and a vibration damper system disposed between the end of the transducer body and the electrical connector assembly. The vibration damper system being operative for attenuating vibrational acceleration and amplification forces experienced by the electrical connector assembly when the transducer is exposed to vibration.

37 Claims, 4 Drawing Sheets

VIBRATION ISOLATED TRANSDUCER CONNECTOR

FIELD OF INVENTION

This invention relates to a transducer and more particularly, to a transducer having an electrical connector assembly that is isolated from the transducer body by a vibration damper system.

BACKGROUND OF THE INVENTION

Pressure sensors, or any other transducers, may be required to operate in extreme environments. Transducers designed for use in aircraft or on-engine applications are exposed to high levels of vibration. Some vibration levels can approach and exceed 300 g's.

FIG. 1 shows an embodiment of a conventional transducer 10 used in high vibration environments. The transducer 10 includes an elongated, transducer body 11 having a first end 12 that defines an end surface 13 for mounting the transducer 10, for example, to the surface of an aircraft wing or engine. Space constraints at the transducer location may require that the transducer's electrical connector assembly 14, which is comprised of an electrical connector 14*a*, a mating connector half 14*b*, and a wiring harness (not shown), be mounted to a second end 15 of the transducer body 11, or other location, where the vibration and structure amplify the force experienced at the electrical connector assembly or other critical weld. To minimize amplification force of the vibration at the connector assembly, it is preferred to have the connector assembly and its associated mass as low as possible, and to locate the connector assembly to decrease the cantilever length. Space constraints, however, may preclude this construction.

The electrical connector assembly's 14 size is typically minimized to reduce the weight of the transducer, and reduce its the cost. These requirements also reduce the size of the weld 16 attaching the connector assembly to the transducer body 11. The reduced size of the weld 16 reduces its load capacity, which is comprised of the electrical connector 14*a*, the mating connector half 14*b*, and the wiring harness of the electrical connector assembly 14. Exceeding this critical load at vibration, with the acceleration and amplification effects caused thereby, results in fracture of the weld 16 or failure of the connector assembly 14. This may be catastrophic in a control transducer.

Accordingly, there is a need for a transducer that is capable of operating in high vibration environments without electrical connector assembly failure.

SUMMARY OF INVENTION

One aspect of the present invention is a transducer having an electrical connector assembly that is isolated from the transducer body by a vibration damper system. The transducer comprises a transducer body, a sensor associated with the transducer body, an electrical connector assembly fastened to an end of the transducer body; and a vibration damper system disposed between the end of the transducer body and the electrical connector assembly for attenuating vibrational acceleration and amplification forces experienced by the electrical connector assembly when the transducer is exposed to vibration. In one embodiment of the transducer, the sensor comprises a pressure sensor.

Another aspect of the present invention is a method of attenuating vibrational acceleration and amplification forces experienced by an electrical connector assembly of a transducer when the transducer is exposed to vibration. The method comprises the steps of providing a transducer having a transducer body, a sensor associated with the transducer body, and an electrical connector assembly fastened to an end of the transducer body, and disposing a vibration damper system between the end of the transducer body and the electrical connector assembly. In one embodiment of the method, the sensor comprises a pressure sensor.

DETAILED DESCRIPTION

The present invention is a transducer having an electrical connector assembly that is isolated from the transducer body by a vibration damper system. The vibration damper system minimizes the effect of vibration, often experienced by transducers designed for operation in extreme environments, such as but not limited to pressure transducers used in aircraft or on-engine applications where the vibration levels can approach and exceed 300 g's.

Figure 1:
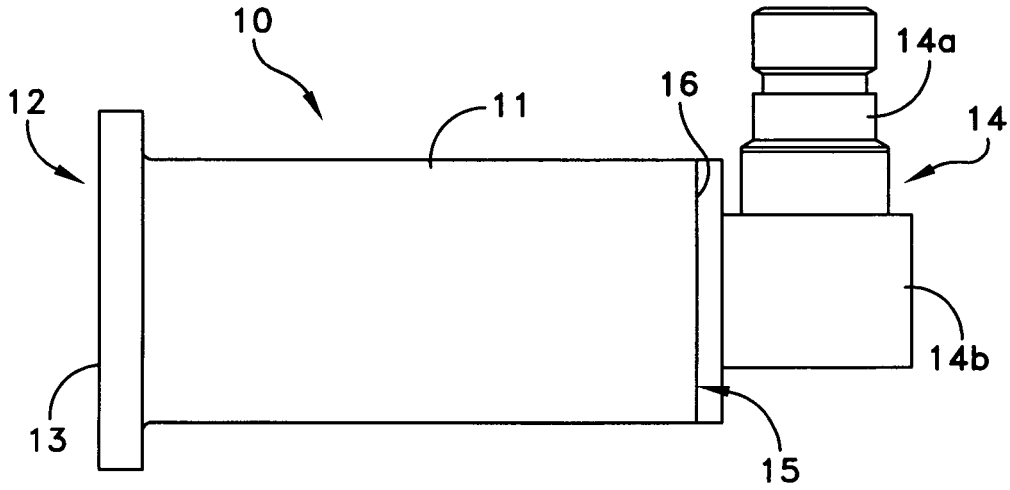
FIG. 1 (PRIOR ART)
FIG. 1 is a side elevational view of a prior art transducer.
Figure 2:
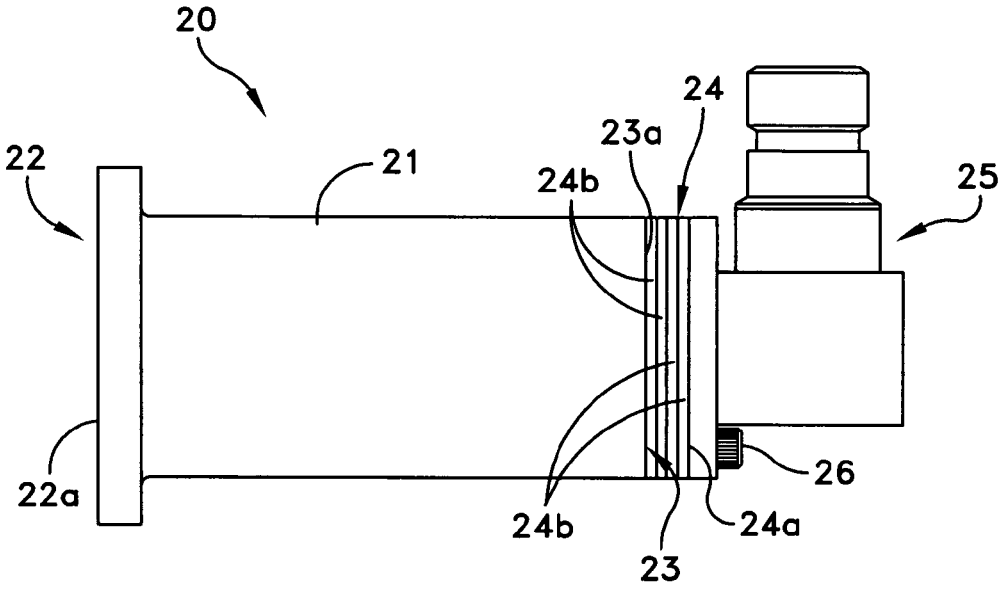
FIG. 2 is a side elevational view of a transducer according to an embodiment of the present invention.

Referring now to FIG. 2, there is shown an embodiment of a transducer 20 made according the present invention. The transducer 20 includes an elongated, transducer body 21 having a first end 22 and an opposite second end 23. The first end 22 of the transducer body 21 defines a first end surface 22*a* for mounting the transducer 20, for example but not limitation, to the surface of an aircraft wing or engine (not shown). The second end 23 of the transducer body 21 defines a second end surface 23*a* that mounts a vibration damper system 24 and electrical connector assembly 25. The vibration damper system 24 is mounted directly on the second end surface 23*a* of the transducer body 21. The electrical connector assembly 25, in turn, is directly mounted to an end surface 24*a* of the vibration damper system 24. One or more conventional fasteners 26 may be used for fastening the vibration damper system 24 and the electrical connector assembly 25 to the second end surface 23*a* of the transducer body 21.

Figure 6A:
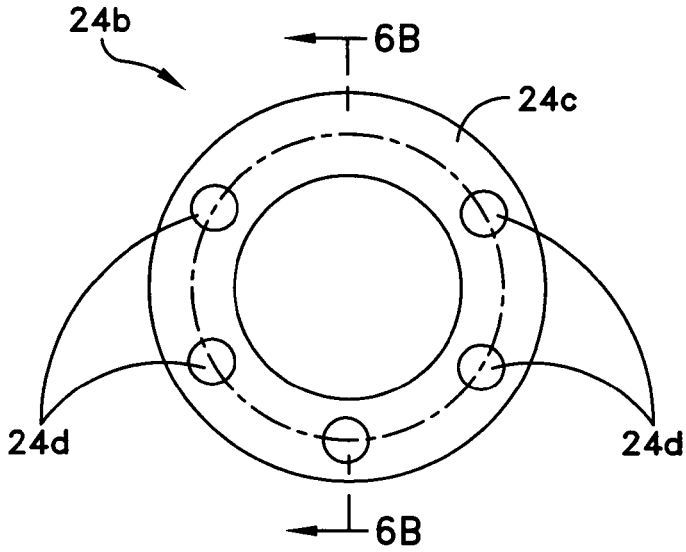
FIG. 6A is a plan view of a substrate used in a vibration damper system of the transducer of FIG. 2.
Figure 6B:
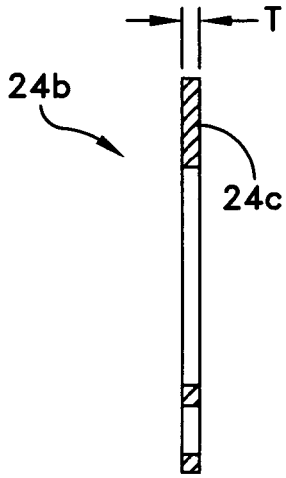
FIG. 6B is cross sectional view through line 6B—6B of FIG. 6A.

The vibration damper system 24 may comprise a single substrate (not shown), or in the shown embodiment, a stack of substrates 24*b*. The one or more substrates 24*b* can be made from an elastic material, such as polytetrafluorethylene (TEFLON), a polymeric material such as copolymer of vinylidene fluoride and hexafluoropropene (VITON rubber) which may have a SHORE A durometer of 75, or any other material capable of attenuating the amplification and acceleration forces acting on the electrical connector assembly which are caused by vibration of the transducer. As shown in FIG. 6A, each substrate 24*b* may comprise an annular body 24*c* having a plurality of openings 24*d*. As shown in FIG. 6B, the body 24*c* of the substrate 24*b* may have a thickness T of about 0.06 inches.

In the earlier mentioned single substrate embodiment, the substrate may be made from an elastomeric or polymeric material. In the stack of substrates embodiment, one or more of the substrates may be made from an elastomeric material and the remaining substrates may be made from a polymeric material. In the shown embodiment of FIG. 2 (also shown in FIG. 3), substrates 24*b* of elastomeric and polymeric material are alternatively disposed in the stack. In still a further embodiment, all the substrates of the stack may be made from an elastomeric material or from a polymeric material.

The attenuation provided by vibration damper system 24 of the present invention can be adjusted to one or more selected frequencies of vibration. This can be accomplished by varying the specific material composition, thickness, and durometer of the substrate or substrates 24*b*.

Figure 3:
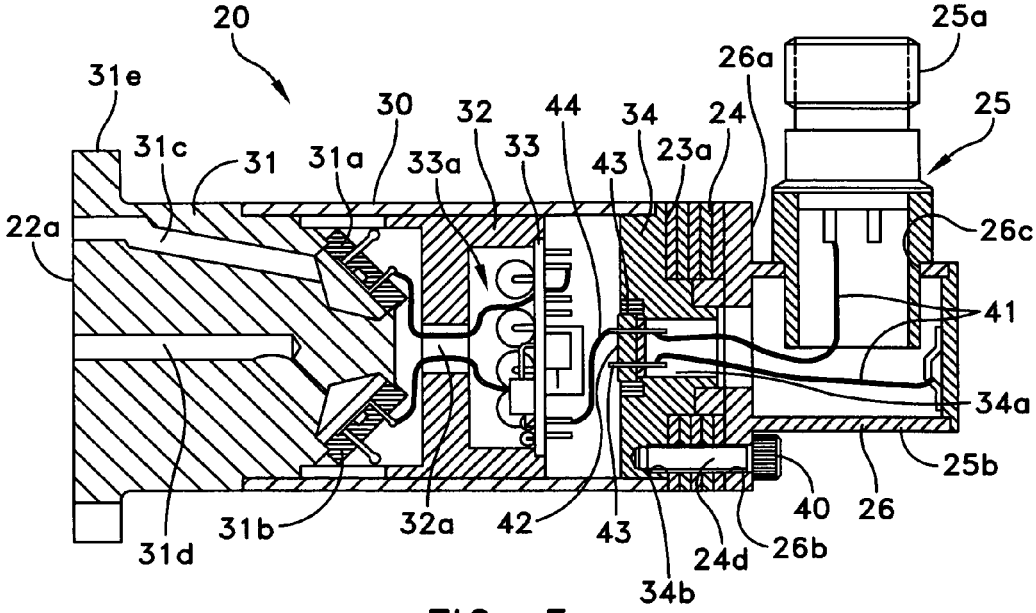
FIG. 3 is a side cross-sectional view of the transducer of FIG. 2.

As shown in FIG. 3, the transducer body 21 may be constructed with a cylindrical tube main body member 30, a cylindrical feed-through glass seal header assembly 31 disposed in a one open end of the main body member 30 and welded or otherwise secured thereto, a partition member 32 with a wire pass-through opening 32*a* disposed within the tube member 30, just behind the header assembly 31, and a circular closure member 34 having a wire pass-through opening 34*a*, disposed in the opposite open end 30*b* of the tube member 30 and welded or otherwise secured thereto. The header assembly 31 defines the earlier described first end surface 22*a* of the transducer body 21 and the closure member 34 defines the earlier described second end surface 23*a* of the transducer body 21.

Figure 4:
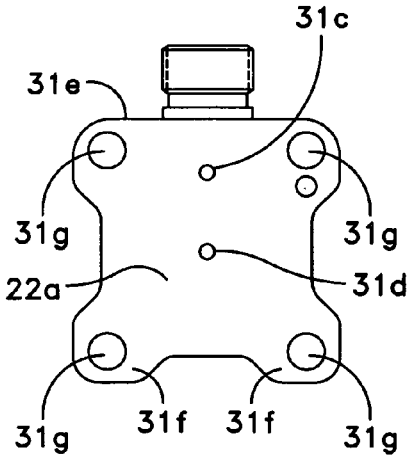
FIG. 4 is a first end view of the transducer of FIG. 2.
Figure 5:
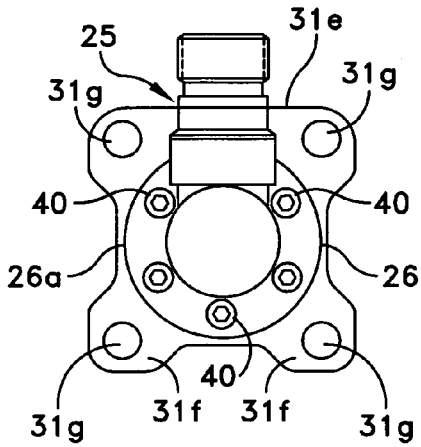
FIG. 5 is a second end view of the transducer of FIG. 2.

The feed-through glass seal header assembly 31 is well known in art (see for example U.S. Pat. No. 5,955,771, entitled SENSORS FOR USE IN HIGH VIBRATIONAL APPLICATIONS AND METHODS FOR FABRICATING SAME issued to Kurtz et al.). The feed-through glass seal header assembly shown in FIG. 3 includes low pressure sensor 31*a* and high pressure sensor 31*b*. Low and high pressure ports 31*c*, 31*d* extend through the header assembly 31 from the first end surface 22*a*, and communicate with respective ones of the first and second pressure sensors 31*a*, 31*b*. The header assembly 31 further includes an upper flange 31*e* and lower corner flanges 31*f* (FIG. 4). The flanges 31*e*, 31*f* have apertures 31*g* for receiving conventional fasteners, which fasten the transducer 20 to the surface of the device it is intended to be used for.

The partition member 32 mounts a circuit board 33 that carries various transducer electronics 33*a*. Since such electronics are well known in the art, no further description the electronics 33*a* is needed and will not be provided herein. The feed-through glass seal header assembly 31 maintains the transducer electronics 33*a* in a hermetically sealed environment.

The electrical connector assembly 25 includes an electrical connector 25*a*, a mating connector half 25*b*, and a wiring harness (not shown). In the shown embodiment, the mating connector half 25*b* is formed by a cylindrical, cap-like housing 26. The closure mating end (open end) of the housing 26 may be surrounded by a circular, peripheral flange 26*a* that mates with the vibration damper system 24 and enables attachment of the electrical connector assembly 25 and vibration damper system 24 to the second end surface 23*c* (defined by the closure member 34 in this embodiment) of the transducer body 21. This may be accomplished by providing one or more space apart openings 26*b* in the flange 26*a*, which align with the openings 24*d* extending through the substrate or substrates 24*b* of the vibration damper system 24 and threaded closed end openings 34*b* in closure member 34. The openings 34*b* in the closure member 34 threadedly engage screw type fasteners 40 that extend through the flange openings 26*b* and the substrate openings 24*d*.

The housing 26 includes a side aperture 26*c* which receives the electrical connector 25*a*. The electrical connector 25*a* may be welded or otherwise secured within the side aperture 26*c* of the connector housing 26. The wires 41 of the wiring harness (not shown) extend through the connector 25*a* and the housing 26 of the mating connector half 25*b* and attach to pins 43 of an electrical feed-through 42 disposed in the wire pass-through opening 34*a* of the closure member 34. The pins 43 of the electrical feed-through 42 are also electrically connected by wires 44 to the transducer electronics 33*c* on the circuit board 33, thus, electrically connecting the wiring harness of the electrical connector assembly 25 to the transducer electronics 33*a*.

The vibration damper system of the present invention enables the transducer to operate in severe vibration applications with high amplifications and accelerations as it attenuates these forces, thereby isolating the electrical connector assembly from the same. Savings in footprint real estate can also be realized by employing the vibration damper of the present invention, because it allows the electrical connector assembly 25 to be mounted at the end or top of the transducer 20, at the highest amplification, as shown in FIGS. 2–5. The vibration damper system can be tuned to act as a low pass filter, attenuating frequencies above a selected critical frequency.

What is claimed is:

1. A transducer comprising:

a transducer body having a first end and a second end opposite the first end, the first end mounted to a surface being exposed to vibrational acceleration and amplification forces over 100 g, the second end defining a closure member surrounded by a peripheral flange;

a sensor associated with the transducer body;

an electrical connector assembly fastened to the closure member of the transducer body via at least one substrate;

wherein said at least one substrate is made from an elastic material, and is disposed between the second end of the transducer body and the electrical connector assembly, wherein said at least one substrate attenuates said vibrational acceleration and amplification forces from said surface to thereby vibrationally isolate said electrical connector from said transducer body.

2. The transducer according to claim 1, wherein the at least one substrate of elastic material has at least one property that is set to a value that adjusts the attenuation of the at least one substrate of elastic material to at least one selected frequency of vibration.

3. The transducer according to claim 2, wherein the at least one property is selected from the group consisting of material composition, material durometer, substrate thickness and combinations thereof.

4. The transducer according to claim 1, wherein the at least one substrate of elastic material comprises a plurality substrates, each of the substrates made from an elastic material.

5. The transducer according to claim 4, wherein the each of the substrates of elastic material has at least one property that is set to a value that adjusts the attenuation of the at least one substrate of elastic material to at least one selected frequency of vibration.

6. The transducer according to claim 5, wherein the at least one property is selected from the group consisting of material composition, material durometer, substrate thickness and combinations thereof.

7. The transducer of claim 1, wherein the electrical connector assembly has a mating end having a through hole aligned with a corresponding through hole in said at least one substrate and with a bore in said second end defining said closure member for receiving a fastener that fastens said electrical connector assembly and said closure member via said at least one substrate.

8. The transducer of claim 1, wherein the thickness of the substrate is about 0.06 inches and wherein said vibrational acceleration and amplification forces attain about 300 g.

9. The transducer of claim 1, wherein the transducer body includes a first portion containing the sensor, a second portion connected to said first portion and containing transducer electronic components and a third portion connected to said second portion and containing said closure member.

10. A pressure transducer comprising:

a transducer body having a first end and a second end opposite the first end, the second end defining a closure member surrounded by a peripheral flange;

a pressure sensor associated with the transducer body;

an electrical connector assembly fastened to the closure member of the transducer body via at least one substrate; and at least one substrate made from an elastic material disposed between the second end of the transducer body and the electrical connector assembly, wherein said at least one substrate attenuates vibrational acceleration and amplification forces experienced by the electrical connector assembly when the transducer is exposed to non transitory vibration.

11. The transducer according to claim 10, wherein the at least one substrate of elastic material has at least one property that is set to a value that adjusts the attenuation of the at least one substrate of elastic material to at least one selected frequency of vibration.

12. The transducer according to claim 11, wherein the at least one property is selected from the group consisting of material composition, material durometer, substrate thickness and combinations thereof.

13. The transducer according to claim 10, wherein the at least one substrate of elastic material comprises a plurality substrates, each of the substrates made from an elastic material.

14. The transducer according to claim 13, wherein the each of the substrates of elastic material has at least one property that is set to a value that adjusts the attenuation of the at least one substrate of elastic material to at least one selected frequency of vibration.

15. The transducer according to claim 14, wherein the at least one property is selected from the group consisting of material composition, material durometer, substrate thickness and combinations thereof.

16. A method of attenuating vibrational acceleration and amplification forces experienced by an electrical connector assembly of a transducer when the transducer is exposed to vibration, the method comprising the steps of:

providing a transducer having a transducer body having a first end and a second end opposite the first end, the second end defining a closure member surrounded by a peripheral flange, a sensor associated with the transducer body, and an electrical connector assembly fastened to the closure member of the transducer body; and disposing at least one substrate made from an elastic material between the second end of the transducer body and the electrical connector assembly.

17. The method according to claim 16, wherein the disposing step comprises: setting at least one property of the at least one substrate of elastic material to a value that adjusts the attenuation of the at least one substrate of elastic material to at least one selected frequency of vibration; disposing the at least one substrate of elastic material between the end of the transducer body and the electrical connector assembly.

18. The method according to claim 17, wherein the at least one property is selected from the group consisting of material composition, material durometer, substrate thickness and combinations thereof.

19. The method according to claim 16, wherein the at least one substrate of elastic material comprises a plurality substrates, each of the substrates made from an elastic material.

20. The method according to claim 19, wherein the disposing step comprises: setting at least one property of each of the substrates of elastic material to a value that adjusts the attenuation of the at least one substrate of elastic material to at least one selected frequency of vibration; disposing the substrates of elastic material between the end of the transducer body and the electrical connector assembly.

21. The method according to claim 20, wherein the at least one property is selected from the group consisting of material composition, material durometer, substrate thickness and combinations thereof.

22. A transducer comprising:

a transducer body having a first end and a second end opposite the first end, the second end defining a closure member surrounded by a peripheral flange;

a sensor associated with the transducer body;

an electrical connector assembly fastened to the closure member of the transducer body via at least one substantially planar substrate; and wherein said at least one substantially planar substrate is made from an elastic, electrically non-conducting material disposed between the second end of the transducer body and the electrical connector assembly and attenuates said vibrational acceleration and amplification forces experienced by the electrical connector assembly when the transducer is exposed to non transitory vibration.

23. The transducer according to claim 22, wherein the at least one substantially planar substrate of elastic, electrically non-conducting material has at least one property that is set to a value that adjusts the attenuation of the at least one substrate of elastic material to at least one selected frequency of vibration.

24. The transducer according to claim 23, wherein the at least one property is selected from the group consisting of material composition, material durometer, substrate thickness and combinations thereof.

25. The transducer according to claim 22, wherein the at least one substantially planar substrate of elastic, electrically non-conducting material comprises a plurality substrates, each of the substrates made from an elastic, electrically non-conducting material.

26. The transducer according to claim 25, wherein the each of the substrates of elastic, electrically non-conducting material has at least one property that is set to a value that adjusts the attenuation of the at least one substrate of elastic, electrically non-conducting material to at least one selected frequency of vibration.

27. The transducer according to claim 26, wherein the at least one property is selected from the group consisting of material composition, material durometer, substrate thickness and combinations thereof.

28. A pressure transducer comprising:

a transducer body having a first end and a second end opposite the first end, the second end defining a closure member surrounded by a peripheral flange;

a pressure sensor associated with the transducer body;

an electrical connector assembly fastened to the closure member of the transducer body via at least one substantially planar substrate; and wherein said at least one substantially planar substrate is made from an elastic, electrically non-conducting material disposed between the second end of the transducer body and the electrical connector assembly and attenuates said vibrational acceleration and amplification forces experienced by the electrical connector assembly when the transducer is exposed to non transitory vibration.

29. The transducer according to claim 28, wherein the at least one substantially planar substrate of elastic, electrically non-conducting material has at least one property that is set to a value that adjusts the attenuation of the at least one substrate of elastic material to at least one selected frequency of vibration.

30. The transducer according to claim 29, wherein the at least one property is selected from the group consisting of material composition, material durometer, substrate thickness and combinations thereof.

31. The transducer according to claim 28, wherein the at least one substrate of elastic, electrically non-conducting material comprises a plurality substrates, each of the substrates made from an elastic, electrically non-conducting material.

32. The transducer according to claim 31, wherein the each of the substrates of elastic, electrically non-conducting material has at least one property that is set to a value that adjusts the attenuation of the at least one substrate of elastic, electrically non-conducting material to at least one selected frequency of vibration.

33. The transducer according to claim 32, wherein the at least one property is selected from the group consisting of material composition, material durometer, substrate thickness and combinations thereof.

34. A method of attenuating vibrational acceleration and amplification forces experienced by an electrical connector assembly of a transducer when the transducer is exposed to vibration, the method comprising the steps of:

providing a transducer having a transducer body having a first end and a second end opposite the first end, the second end defining a closure member surrounded by a peripheral flange;

providing a sensor associated with the transducer body;

providing an electrical connector assembly;

disposing at least one substantially planar substrate of an elastic, electrically non-conducting material between the second end of the transducer body and the electrical connector assembly; and fastening said electrical connector assembly to said closure member of said transducer body via said at least one substantially planar substrate.

35. The method according to claim 34, further comprising the step of setting at least one property of the at least one substrate of elastic, electrically non-conducting material to a value that adjusts the attenuation of the at least one substrate of elastic, electrically non-conducting material to at least one selected frequency of vibration.

36. The method according to claim 35, wherein the at least one property is selected from the group consisting of material composition, material durometer, substrate thickness and combinations thereof.

37. The method according to claim 34, wherein the step of disposing said at least one substrate of elastic, electrically non-conducting material comprises disposing a plurality of substrates, of an elastic, electrically non-conducting material between said second end of said transducer body and said electrical connector assembly.

* * * * *